United States Patent [19]

Faarbech

[11] 4,063,670

[45] Dec. 20, 1977

[54] CLOTHES HANGER

[76] Inventor: Jens Faarbech, 405 Fifth St. Apt. 5, Solvang, Calif. 93463

[21] Appl. No.: 766,607

[22] Filed: Feb. 7, 1977

[51] Int. Cl.[2] ..... A47J 51/095
[52] U.S. Cl. ..... 223/92
[58] Field of Search ..... 223/85, 88, 89, 90, 223/92, 93, 94, 95

[56] References Cited

U.S. PATENT DOCUMENTS

| | | | |
|---|---|---|---|
| 881,818 | 3/1908 | Morrison et al. | 223/85 X |
| 1,893,815 | 1/1933 | Wilt et al. | 223/88 |

FOREIGN PATENT DOCUMENTS

| | | | |
|---|---|---|---|
| 171,599 | 6/1960 | Sweden | 223/85 |

*Primary Examiner*—George H. Krizmanich
*Attorney, Agent, or Firm*—Jack C. Munro

[57] ABSTRACT

A clothes hanger which is formed of an elongated integral housing with an enlarged opening located centrally within the housing, a hook member locatable within the enlarged opening and movable in respect to the housing between a retracted position and an extended position, the hook member including an elongated slot, a pin cooperating within the elongated slot and fixedly secured to the housing, the hook member being manually movable from a retracted position to an extended position to permit the hanger to be supported upon any clothes supporting rod.

3 Claims, 4 Drawing Figures

CLOTHES HANGER

BACKGROUND OF THE INVENTION

The field of this invention relates to hanging devices and more particularly to a clothes hanger in which the hook portion of the hanger is retractable.

It is extremely common to hang a shirt, a blouse or other garment upon a hanger device and then suspend that hanger device from an elongated cylindrical rod within a closet. Such hanging devices have long been known and there is a wide variety of hanger constructions.

Most such hanger constructions of the prior art provide for the hanger section of the device to be integral with and fixed to the remaining portion of the hanger. When the device is supported upon the supporting rod, the hook portion functions as desired. However, when the hanger is removed from the supporting rod, which it frequently is, the hook portion of a hanger can and frequently does become entangled with other hooks of other hangers or becomes caught within garments or can cause damage to other objects. Also, in the hanging of sweaters, the hook of a conventional hanger frequently becomes entangled with the sweater.

Therefore, it would be desirable to design within a clothes hanger a hook which retracts within the body portion of the hanger when the hanger is not located upon the supporting rod.

SUMMARY OF THE INVENTION

The subject matter of this invention is believed to be summarily described within the Abstract Of The Disclosure and reference is to be had thereto.

The primary objective of the apparatus of this invention is to design a clothes hanger which includes a retractable hook so that the hook will not be capable of causing damage or injury or become entangled with other objects when the hanger is not placed upon the supporting rod. The hanger of this invention is designed primarily for sweaters, particularly turtleneck sweaters which have been, in the past, difficult to place upon a hanger. The hook of the hanger of this invention, when retracted, cannot become entangled in the sweater.

DETAILED DESCRIPTION OF THE SHOWN EMBODIMENT

Figure 1:
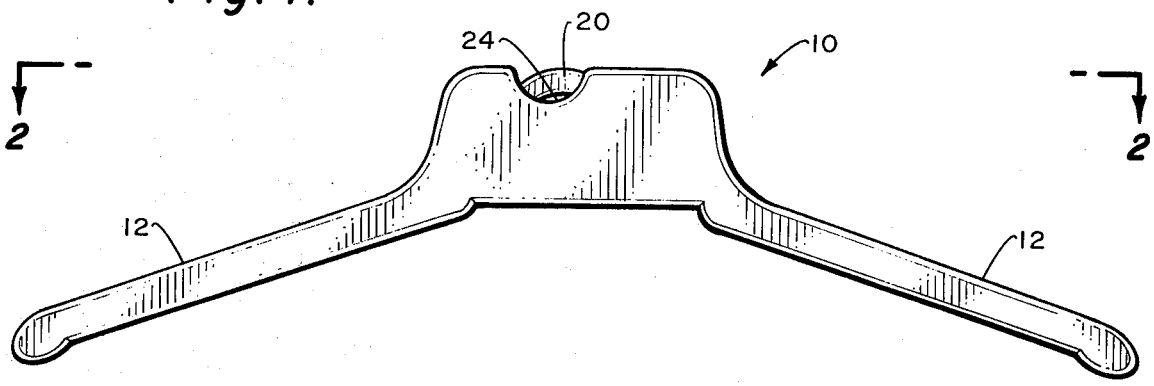
FIG. 1 is a side elevational view of the clothes hanger of this invention.
Figure 2:
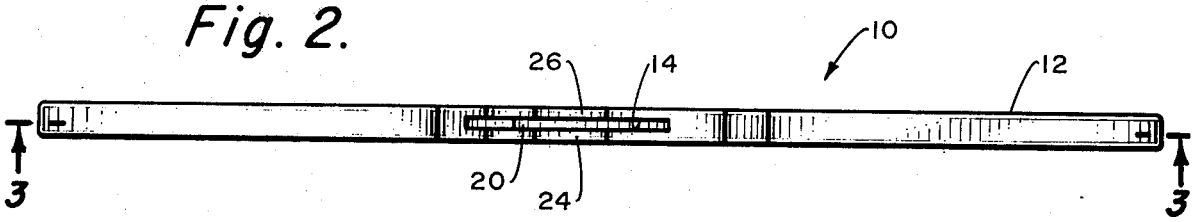
FIG. 2 is a top view of the clothes hanger of this invention taken along line 2—2 of FIG. 1.

Referring particularly to the drawing, there is shown the clothes hanger 10 of this invention which is provided with an elongated body 12 which is formed basically into the shape of a conventional clothes hanger. The body 12 will normally be constructed of a plastic material, however, it is considered to be within the scope of this invention to construct the hanger of other types of materials. Upon the body 12 a garment, such as a blouse or a sweater or a shirt is to be hung in a conventional manner.

Intermediate the ends of the longitudinal body 12 and located substantially centrally thereof is an enlarged, thin opening 14. Extending across the opening 14 fixedly secured within the housing 12 is a metal pin 16. The pin 16 communicates with an elongated slot 18 formed within a hook member 20. The hook member 20 also is to be constructed of a plastic material.

Figure 3:
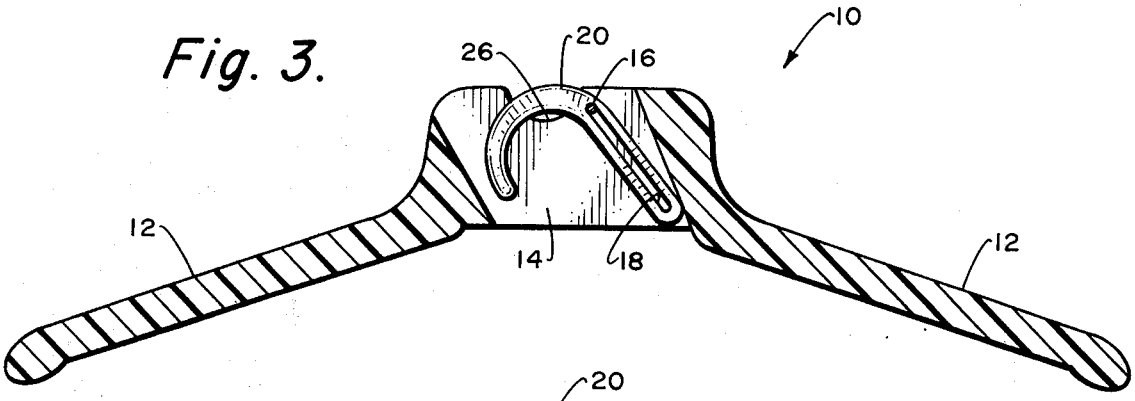
FIG. 3 is a cross-section view taken along line 3—3 of FIG. 2.
Figure 4:
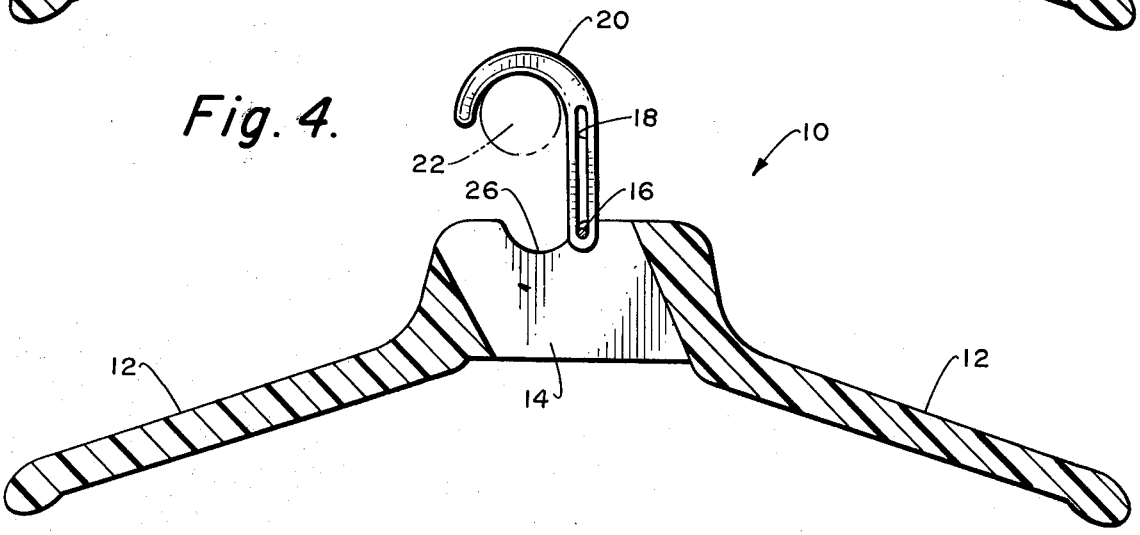
FIG. 4 is a view similar to FIG. 3 but showing the hook portion extended and being located upon a supporting rod.

The hook member 20 is capable of being almost totally locatable within the enlarged opening 14 as is shown in FIGS. 1 and 3 of the drawing. This is a naturally at rest position for the hook 20 when the hook 20 is not placed upon a supporting rod 22, such as shown in FIG. 4 of the drawing. In other words, the hook portion, when it is removed from the supporting rod 22 will actually just fall under the action of gravity to almost totally within the enlarged opening 14.

In order to cause extension of the hook 20 so as to facilitate placement upon the supporting rod 22, a pair of recesses 24 and 26 are provided within the upper edge surface of the housing 12. The recesses 24 and 26 are in alignment and merely are to provide for physical grasping of the upper surface of the hook portion 20 to facilitate manual movement of such to the extended position.

In order to facilitate balancing the hanger of this invention when it is used, the pin 16 is equally spaced from each of the ends of the housing 12. In other words, if a line could be drawn separating the parts of the housing 12 into two identical pieces (but mirror images of each other), the center of the pin 16 will pass through that line.

What is claimed is:

1. A clothes hanger comprising:

an elongated housing, said elongated housing terminating in a first end and a second end;

an enlarged opening formed within said housing intermediate said ends;

a metal pin extending across said opening and fixedly secured to said housing;

a hook member having an elongated closed slot, said hook member adapted to be supported upon a supporting rod, said pin cooperating within said elongated slot, said hook member being movable between a retracted position totally enclosed within said enlarged opening to an extended position to facilitate placement of said hook member upon a supporting rod; and said housing including recess means within said housing communicating with said enlarged opening, with said hook member located in the retracted position within said enlarged opening, said hook member being slightly exposed by said recess means to facilitate manual grasping of said hook member, the upper edge of said housing located on each side of said recess means being planar to facilitate the supporting of garments.

2. The clothes hanger as defined in claim 1 wherein:

said enlarged opening being located at the approximate mid point of the longitudinal length of said housing.

3. The clothes hanger as defined in claim 2 wherein:

said pin being equally spaced from both said first end and said second end so as to permit said clothes hanger to be in a level position with the hook member located upon a supporting rod.

* * * * *